US007045961B2

(12) United States Patent
Takahashi

(10) Patent No.: US 7,045,961 B2
(45) Date of Patent: May 16, 2006

(54) HIGH-PRESSURE DISCHARGE LAMP

(75) Inventor: Hiroshi Takahashi, Himeji (JP)

(73) Assignee: Phoenix Electric Co., Ltd., Hyogo (JP)

( * ) Notice: Subject to any disclaimer, the term of this patent is extended or adjusted under 35 U.S.C. 154(b) by 183 days.

(21) Appl. No.: 10/835,801

(22) Filed: Apr. 29, 2004

(65) Prior Publication Data

US 2004/0217705 A1 Nov. 4, 2004

(30) Foreign Application Priority Data

May 2, 2003 (JP) ..... 2003-127087

(51) Int. Cl.
*H01J 17/20* (2006.01)

(52) U.S. Cl. ..... 313/574; 313/576; 313/633

(58) Field of Classification Search ..... 313/491, 313/574, 576, 579, 631, 633, 637
See application file for complete search history.

(56) References Cited

FOREIGN PATENT DOCUMENTS

JP 11-149899 6/1999

*Primary Examiner*—Vip Patel
(74) *Attorney, Agent, or Firm*—Jordan and HamburgLLP

(57) ABSTRACT

There is provided an improved high-pressure discharge lamp which includes an arc tube encapsulating a halogen, and a pair of tungsten electrodes disposed in the arc tube. The oxygen content in the tungsten electrodes is not more than 15 ppm, while the amount of the encapsulated halogen lies in the range of $1\times10^{-7}$ to $1\times10^{-2}$ μmol/mm$^3$.

2 Claims, 6 Drawing Sheets

Fig. 2

[Experiment 1]

| lighting time | | 0h | 1000h | 2000h | 3000h |
|---|---|---|---|---|---|
| sample 1 30ppm | shape | 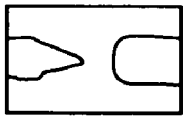 | 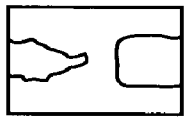 | 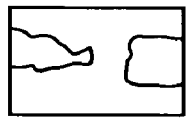 | 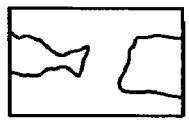 |
| | blackening | not found ○ | not found ○ | not found ○ | found × |
| | flicker | not found ○ | found × | found × | found × |
| sample 2 24ppm | shape | 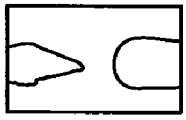 | 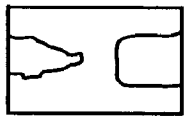 | 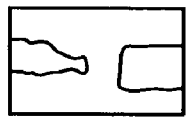 | 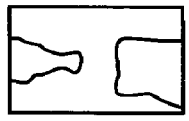 |
| | blackening | not found ○ | not found ○ | not found ○ | found × |
| | flicker | not found ○ | found × | found × | found × |
| sample 3 22ppm | shape | 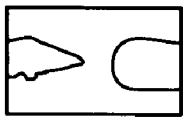 | 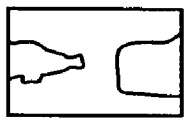 | 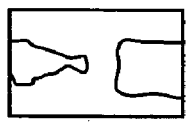 | 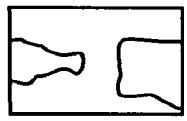 |
| | blackening | not found ○ | not found ○ | not found ○ | not found ○ |
| | flicker | not found ○ | not found ○ | found × | found × |
| sample 4 20ppm | shape | 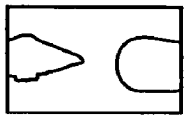 | 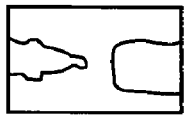 | 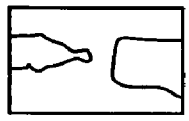 | 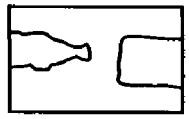 |
| | blackening | not found ○ | not found ○ | not found ○ | not found ○ |
| | flicker | not found ○ | not found ○ | found × | found × |
| sample 5 18ppm | shape | 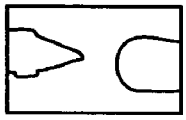 | 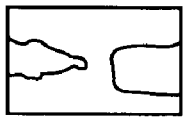 | 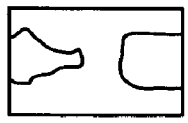 | 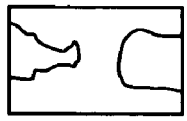 |
| | blackening | not found ○ | not found ○ | not found ○ | found × |
| | flicker | not found ○ | not found ○ | not found ○ | found × |
| sample 6 17ppm | shape | 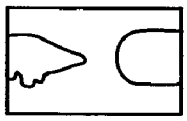 | 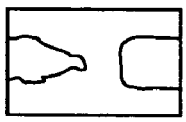 | 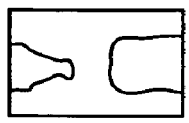 | 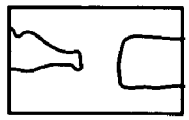 |
| | blackening | not found ○ | not found ○ | not found ○ | not found ○ |
| | flicker | not found ○ | not found ○ | found × | found × |

Fig. 3

[Experiment 1]

| 点灯時間 | | 0h | 1000h | 2000h | 3000h |
|---|---|---|---|---|---|
| sample 7 15ppm | shape | | | | |
| | blackening | not found ○ | not found ○ | not found ○ | not found ○ |
| | flicker | not found ○ | not found ○ | not found ○ | not found ○ |
| sample 8 9ppm | shape | | | | |
| | blackening | not found ○ | not found ○ | not found ○ | not found ○ |
| | flicker | not found ○ | not found ○ | not found ○ | not found ○ |
| sample 9 6ppm | shape | | | | |
| | blackening | not found ○ | not found ○ | not found ○ | not found ○ |
| | flicker | not found ○ | not found ○ | not found ○ | not found ○ |
| sample 10 5ppm | shape | | | | |
| | blackening | not found ○ | not found ○ | not found ○ | not found ○ |
| | flicker | not found ○ | not found ○ | not found ○ | not found ○ |
| sample 11 <5ppm | shape | | | | |
| | blackening | not found ○ | not found ○ | not found ○ | not found ○ |
| | flicker | not found ○ | not found ○ | not found ○ | not found ○ |
| sample 12 <5ppm | shape | | | | |
| | blackening | not found ○ | not found ○ | not found ○ | not found ○ |
| | flicker | not found ○ | not found ○ | not found ○ | not found ○ |

[Experiment 1]

| | | | |
|---|---|---|---|
| sample 1 | 30ppm | sample 7 | 15ppm |
| sample 2 | 24ppm | sample 8 | 9ppm |
| sample 3 | 22ppm | sample 9 | 6ppm |
| sample 4 | 20ppm | sample 10 | 5ppm |
| sample 5 | 18ppm | sample 11 | <5ppm |
| sample 6 | 17ppm | sample 12 | <5ppm |

Fig. 5

[Experiment 2]

| | 点灯時間 | 0h | 1000h | 2000h | 3000h |
|---|---|---|---|---|---|
| sample 1 $1\times10^{-8}$ μmol/mm³ | shape | | broken due to blackning | broken due to blackning | broken due to blackning |
| | blackening | not found ○ | — | — | — |
| | flicker | not found ○ | — | — | — |
| sample 2 $5\times10^{-8}$ μmol/mm³ | shape | | | broken due to blackning | broken due to blackning |
| | blackening | not found ○ | not found ○ | — | — |
| | flicker | not found ○ | not found ○ | — | — |
| sample 3 $1\times10^{-7}$ μmol/mm³ | shape | | | | |
| | blackening | not found ○ | not found ○ | not found ○ | not found ○ |
| | flicker | not found ○ | not found ○ | not found ○ | not found ○ |
| sample 4 $1\times10^{-3}$ μmol/mm³ | shape | | | | |
| | blackening | not found ○ | not found ○ | not found ○ | not found ○ |
| | flicker | not found ○ | not found ○ | not found ○ | not found ○ |
| sample 5 $1\times10^{-2}$ μmol/mm³ | shape | | | | |
| | blackening | not found ○ | not found ○ | not found ○ | not found ○ |
| | flicker | not found ○ | not found ○ | not found ○ | not found ○ |
| sample 6 $5\times10^{-2}$ μmol/mm³ | shape | | | | |
| | blackening | not found ○ | not found ○ | not found ○ | found × |
| | flicker | not found ○ | found × | found × | found × |

| | |
|---|---|
| sample 1 | $1\times10^{-8}$ μmol/mm³ |
| sample 2 | $5\times10^{-8}$ μmol/mm³ |
| sample 3 | $1\times10^{-7}$ μmol/mm³ |
| sample 4 | $1\times10^{-3}$ μmol/mm³ |
| sample 5 | $1\times10^{-2}$ μmol/mm³ |
| sample 6 | $5\times10^{-2}$ μmol/mm³ |

HIGH-PRESSURE DISCHARGE LAMP

BACKGROUND OF THE INVENTION

1. Field of the Invention

The present invention relates to a high-pressure discharge lamp for use as a light source of optical equipment such as a liquid crystal projector, for example.

2. Description of the Related Art

Recently, for use as a light source of e.g. optical equipment, a high-pressure discharge lamp has been developed which has a relatively small gap between electrodes (arc length) for enhancing the luminance and light utilization efficiency. However, in a high-pressure discharge lamp of such a short arc type, the tip ends of the electrodes are heated to high temperature, resulting in evaporation of the electrodes. Therefore, when the lamp continues to be lit for a relatively long time, the electrodes are deformed, resulting in so-called arc jump (fluctuation of the luminous point of the electrodes), which causes a flicker.

Further, the evaporated material of the electrodes often adheres to the inner surface of the arc tube, whereby the arc tube is blackened. Furthermore, when the arc comes close to a wall surface of the arc tube due to the deformation of the electrodes, the arc tube may be heated to extremely high temperature.

As a measure to solve these problems, the gazette of JP-A-11-149899 discloses a technique in which the amount of mercury in the arc tube and the halogen gas concentration are optimized while $K_2O$ (potassium oxide) contained in the tungsten electrodes is suppressed to a value not more than 12 ppm for prolonging the lifetime of a high-pressure discharge lamp.

However, such suppression of the $K_2O$ content to prevent blackening of the arc is not sufficiently effective for preventing the deformation of electrodes, and hence, for preventing the arc jump.

SUMMARY OF THE INVENTION

It is, therefore, an object of the present invention to provide a high-pressure discharge lamp capable of effectively preventing the consumption and the resulting deformation of the electrodes.

In accordance with the present invention, there is provided a high-pressure discharge lamp comprising an arc tube encapsulating a halogen therein, and a pair of tungsten electrodes disposed in the arc tube, wherein the tungsten electrodes each have an oxygen content not more than 15 ppm, and the amount of the encapsulated halogen lies in the range of $1\times10^{-7}$ to $1\times10^{-2}$ μmol/mm$^3$.

With this arrangement, by suppressing the oxygen content in the tungsten electrodes to a value not more than 15 ppm, the melting point of the tungsten electrode is prevented from lowering, whereby the consumption of the electrode due to evaporation can be prevented. Moreover, by setting the amount of the halogen to the range of $1\times10^{-7}$ to $1\times10^{-2}$ μmol/mm$^3$, it is possible to prevent the tungsten electrode from being consumed due to the halogen regeneration cycle and preventing the lifetime of the electrode from being shortened due to the rapid corrosion.

Preferably, the electrodes define an electrode gap not more than 1.3 mm.

When the electrode gap is such a small value as not more than 1.3 mm, the high-pressure discharge lamp can provide a point light source suitable for optical equipment such as a liquid crystal projector.

The foregoing and other objects, features and attendant advantages of the present invention will become more apparent from the reading of the following detailed description of the invention in conjunction with the accompanying drawings.

BRIEF DESCRIPTION OF THE DRAWINGS

FIG. 2 is a table illustrating the shape of the electrode and so on of each of the samples 1–6 relative to the lighting time in Experiment 1;

FIG. 3 is a table illustrating the shape of the electrode and so on of each of the samples 7–12 relative to the lighting time in Experiment 1;

FIG. 5 is a table illustrating the shape of the electrode and so on of each of the samples 1–6 in relation to the lighting time.

DETAILED DESCRIPTION OF THE PREFERRED EMBODIMENTS

Preferred embodiments of the present invention will now be described in detail with reference to the accompanying drawings.

Figure 1:
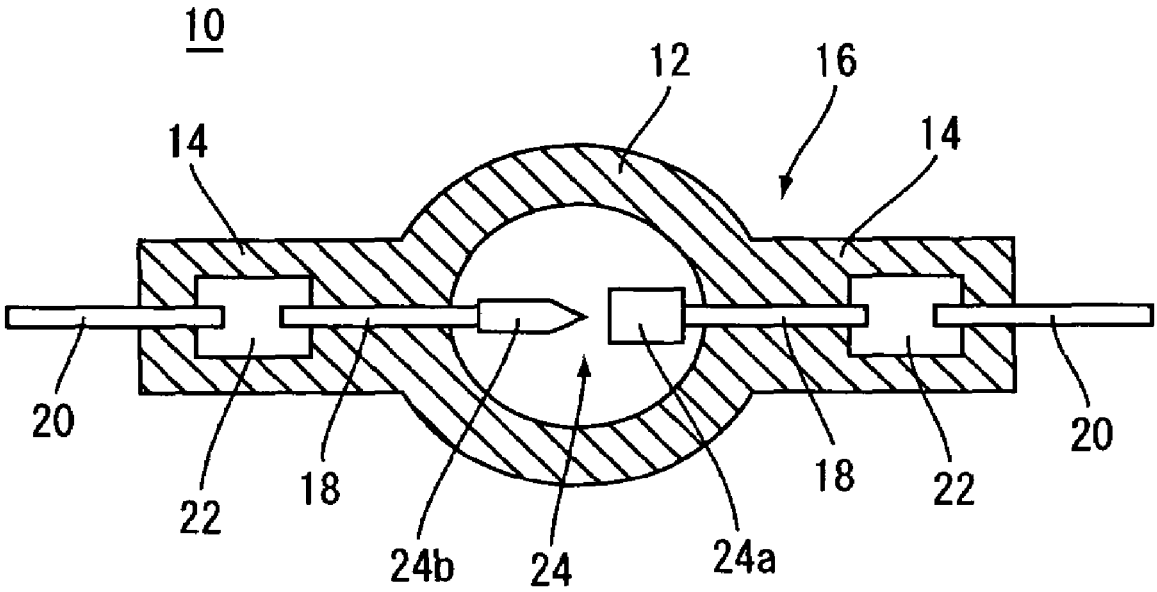
FIG. 1 is a sectional view illustrating a high-pressure discharge lamp.

FIG. 1 is a sectional view illustrating a high-pressure discharge lamp 10 according to an embodiment of the present invention. Although the high-pressure discharge lamp 10 shown in FIG. 1 is constructed as an ultra-high pressure mercury lamp of a double-ended type for DC lighting, the present invention is also applicable to an ultra-high pressure mercury lamp for AC lighting, an ultra-high pressure mercury lamp of a single-ended type or a metal halide lamp, for example.

As shown in FIG. 1, the high-pressure discharge lamp 10 includes an envelope 16 comprising a spherical arc tube 12 and a pair of seal portions 14 extending straight outward from opposite ends of the arc tube 12. Each of the seal portions 14 incorporates an electrode pin 18 having an inner end projecting into the internal space of the arc tube 12, a lead pin 20 having an outer end projecting outward from the seal portion 14, and an molybdenum foil electrically connecting an outer end of the electrode pin 18 to an inner end of the lead pin 20. The inner ends of the two electrode pins 18 are connected respectively to an anode 24*a* and a cathode 24*b* as a tungsten electrode 24 (hereinafter, simply referred to as "electrode"). The arc tube 12 encapsulates therein mercury, a rare gas such as argon, and at least one halogen (as metal halide or halogen gas) such as I (iodine), Br (bromine), Cl (chlorine), F (fluorine), for example.

The amount of the halogen encapsulated in the arc tube 12 lies in the range of $1\times10^{-7}$ to $1\times10^{-2}$ μmol/mm$^3$. The reason why the lower limit of the amount of the halogen is set to $1\times10^{-7}$ μmol/mm$^3$ is that, when the amount is less than $1\times10^{-7}$ μmol/mm$^3$, the halogen regeneration cycle does not work properly due to the absolute lack of halogen. In such a case, blackening occurs early, which may result in the breakage of the arc tube 12. The reason why the upper limit of the amount of the halogen is set to $1\times10^{-2}$ μmol/mm$^3$ is that, when the amount is more than $1\times10^{-2}$ μmol/mm$^3$, the halogen causes rapid corrosion of the electrode 24, which shortens the lifetime of the electrode 24.

Herein, the "halogen regeneration cycle" refers to a cycle which comprises the reaction of tungsten evaporated from the electrode with a halogen to give a tungsten halide, the decomposition of tungsten halide into halogen and tungsten upon heating by the electrode, and the deposition of tungsten given by the decomposition to the electrode to regenerate the electrode.

The inventor of the present invention has found that the optimum amount of the halogen lies in the range of $1\times10^{-7}$ to $1\times10^{-2}$ μmol/mm$^3$ through an experiment, which will be described later.

As shown in FIG. 1, the cathode 24*b* of the electrode 24 has a tapered tip end, thereby having a volume which is smaller than that of the anode 24*a* of the electrode 24. The electrode gap between the anode 24*a* and the cathode 24*b* is set to a value not more than 1.3 mm, or preferably not more than 1 mm (not less than 0.8 mm). Such an electrode gap between the anode 24*a* and the cathode 24*b* can provide a point light source suitable for an optical instrument such as a liquid crystal projector.

In the present invention, the amount of oxygen contained in the electrode 24 (the anode 24*a* and the cathode 24*b*) is set to a value not more than 15 ppm. The inventor of the present invention has found that the suppression of the oxygen content to a value not more than 15 ppm is effective for preventing the thermal consumption and deformation of electrode 24 through an experiment, which will be described later.

Specifically, although it is known that tungsten of higher purity has a higher melting point (of more than 3400 C), it was unknown what is the impurity which tends to lower the melting point of tungsten and to what level the amount of the impurity should be suppressed to effectively prevent the consumption of the electrode.

The inventor of the present invention has studied this theme to find, based on the chemical characteristics of tungsten, that the impurity is oxygen. Specifically, the inventor has found that when the oxygen content is large, rapid oxidation occurs when the temperature exceeds 500 C, which causes much tungsten oxide scatter to result in the consumption of the electrode 24. The inventor also found, through the experiment, that the consumption of the electrode 24 can be effectively prevented when the oxygen content is not more than 15 ppm.

The Experiment 1 to find the optimum oxygen content of the electrode 24 and the Experiment 2 to find the optimum amount of the halogen will be described below.

EXPERIMENT 1

(1) Sample Preparation

Twelve samples 1–12 of the electrode 24, which differ from each other in oxygen content, were prepared. The oxygen content in each of the samples was confirmed by oxygen analysis utilizing high-frequency heating.

Specifically, tungsten as the material of each of the samples 1–12 is put in a crucible and heated in a high-frequency furnace to extract carbon monoxide. The amount of extracted carbon monoxide was measured, whereby the oxygen content in tungsten was determined based on the measurement result.

The samples 1–10 contained oxygen of 30 ppm, 24 ppm, 22 ppm, 20 ppm, 18 ppm, 17 ppm, 15 ppm, 9 ppm, 6 ppm and 5 ppm, respectively. Each of the samples 11 and 12 contained oxygen of less than 5 ppm.

(2) Manner of Experiment

High-pressure discharge lamps were prepared using the twelve sample electrodes, and each of the lamps was examined with respect to the deformation of the electrode and the occurrence of blackening or a flicker after a lapse of 0 h, 1000 h, 2000 h and 3000 h from the starting of the lighting. Further, each of the high-pressure discharge lamps was examined also with respect to the change of luminance with time.

Each of the high-pressure lamps used for the experiment had a power consumption of 270 W, and contained mercury of 0.2 mg/mm$^3$ and Br of $1.1\times10^{-4}$ μmol/mm$^3$ as a halogen. The electrode gap was 1.3 mm.

(3) Experimental Results

Figure 4:
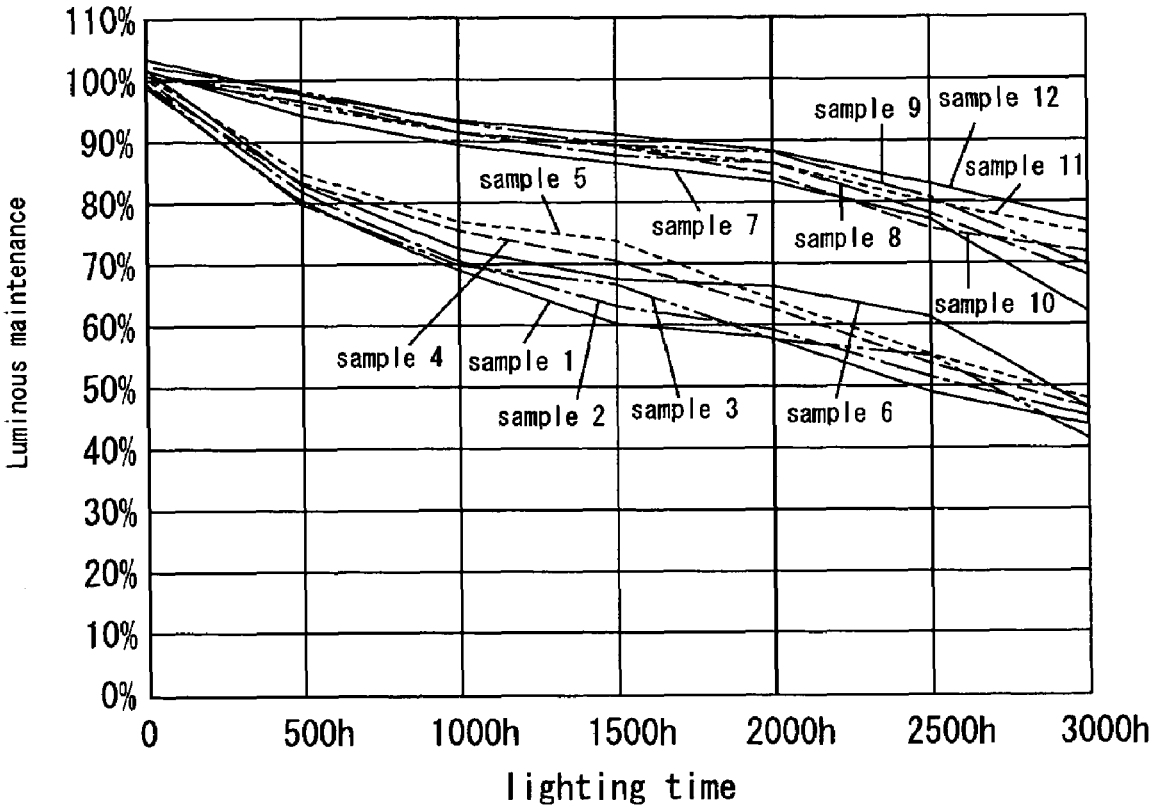
FIG. 4 is a graph showing the relationship between the luminous maintenance and the lighting time of each of the samples 1–12.

The results of the experiment are given in FIGS. 2–4. Specifically, FIGS. 2 and 3 are tables illustrating the shape of the electrode and so on of each of the samples 1–12 relative to the lighting time. FIG. 4 is a graph showing the relationship between the luminous maintenance and the lighting time of each of the samples 1–12.

From the tables of FIGS. 2 and 3, it is found that the consumption of the electrode 24 with time decreases and the blackening or flicker does not occur when the oxygen content in the electrode 24 is not more than 15 ppm. Further, from the graph given in FIG. 4, it is found that the luminous maintenance is considerably high when the oxygen content in the electrode 24 is not more than 15 ppm.

EXPERIMENT 2

(1) Sample Preparation

Six high-pressure discharge lamps were prepared as samples 1–6, which are equal to each other in oxygen content in the electrode 24 (15 ppm) and different from each other in the amount of the halogen encapsulated in the arc tube.

Specifically, the samples 1–6 contained the halogen in amounts of $1\times10^{-8}$ μmol/mm$^3$, $5\times10^{-8}$ μmol/mm$^3$, $1\times10^{-7}$ μmol/mm$^3$, $1\times10^{-3}$ μmol/mm$^3$, $1\times10^{-2}$ μmol/mm$^3$ and $5\times10^{-2}$ μmol/mm$^3$, respectively. Each of the sample lamps had a power consumption of 270 W, and contained mercury of 0.2 mg/mm$^3$. The electrode gap was 1.3 mm. Bromine was used as the halogen.

(2) Manner of Experiment

Each of the sample lamps was examined with respect to the deformation of the electrode and the occurrence of blackening or a flicker after a lapse of 0 h, 1000 h, 2000 h and 3000 h from the starting of the lighting. Further, each of the sample lamps was examined also with respect to change of the luminance with time.

(3) Experimental Results

Figure 6:
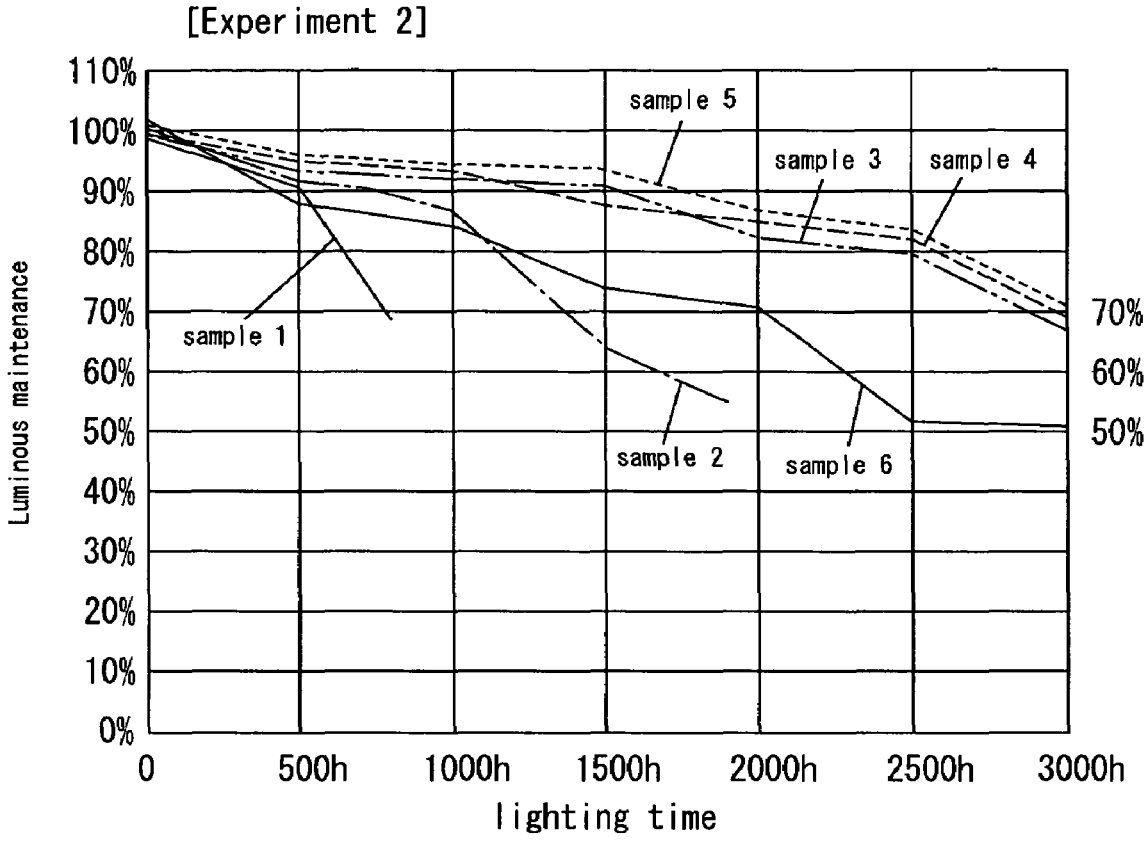
FIG. 6 is a graph showing the relationship between the luminous maintenance and the lighting time of each of the samples 1–6.

The results of the experiment are given in FIGS. 5 and 6. Specifically, FIG. 5 is a table illustrating the shape of the electrode and so on of each of the samples 1–6 in relation to the lighting time. FIG. 6 is a graph showing the relationship between the luminous maintenance and the lighting time of each of the samples 1–6.

From the table of FIG. 5, it is found that the blackening or a flicker does not occur when the amount of the halogen lies in the range of $1\times10^{-7}$ μmol/mm$^3$ to $1\times10^{-2}$ μmol/mm$^3$. Further, from the graph given in FIG. 6, it is found that the luminous maintenance is considerably high when the amount of the halogen lies in the range of $1\times10^{-7}$ to $1\times10^{-2}$ μmol/mm$^3$.

From the results of Experiments 1 and 2, it is concluded that, when the amount of the halogen encapsulated in the arc tube lies in the range of $1\times10^{-7}$ to $1\times10^{-2}$ μmol/mm$^3$ and the oxygen content in the electrode 24 is not more than 15 ppm, the consumption of the electrode 24 as well as blackening and a flicker can be prevented while high luminance can be maintained.

In the foregoing embodiment, the oxygen content in the electrode 24 provided at respective inner ends of the electrode pins 18 is set to a value not more than 15 ppm. However, the oxygen content in the portion of each electrode pin 18 projecting into the arc tube 12 may also be set to a value not more than 15 ppm. That is, in the present invention, oxygen content in at least the electrode 24 at the inner ends of the electrode pins 18 is set to a value not more than 15 ppm.

According to the present invention, by suppressing the oxygen content in the tungsten electrode to a value not more than 15 ppm, the melting point of the tungsten electrode is prevented from lowering, whereby the consumption of the electrode due to evaporation can be prevented. Moreover, by setting the amount of the halogen to the range of $1\times10^{-7}$ μmol/mm$^3$ to $1\times10^{-2}$ μmol/mm$^3$, it is possible to prevent the tungsten electrode from being consumed due to the halogen regeneration cycle and prevent the rapid corrosion of the electrode, whereby the lifetime of the electrode can be prolonged. Thus, blackening and flickers are also prevented from occurring, whereby the lifetime of the high-pressure discharge lamp can be prolonged. Moreover, the high-pressure discharge lamp of the present invention can maintain high illuminance for a long time.

While only certain presently preferred embodiments of the present invention have been described in detail, as will be apparent for those skilled in the art, certain changes and modifications may be made in embodiments without departing from the spirit and scope of the present invention as defined by the following claims.

What is claimed is:

1. A high-pressure discharge lamp comprising an arc tube encapsulating a halogen therein, and a pair of tungsten electrodes disposed in the arc tube, wherein the tungsten electrodes have an oxygen content not more than 15 ppm, while the amount of the encapsulated halogen lies in a range of $1\times10^{-7}$ to $1\times10^{-2}$ μmol/mm$^3$.

2. The high-pressure discharge lamp according to claim 1, wherein the electrodes defines an electrode gap not more than 1.3 mm.

* * * * *